United States Patent [19]

Amagaya

[11] Patent Number: 4,793,537

[45] Date of Patent: Dec. 27, 1988

[54] ROLLED ADHESIVE TAPE HOLDER

[75] Inventor: Hidefumi Amagaya, Tokyo, Japan

[73] Assignee: Plus Corporation, Tokyo, Japan

[21] Appl. No.: 37,184

[22] Filed: Apr. 10, 1987

[30] Foreign Application Priority Data

Oct. 22, 1986 [JP] Japan ..... 61-161946

[51] Int. Cl.[4] ..... B26F 3/02

[52] U.S. Cl. ..... 225/47; 225/44; 225/66; 225/90

[58] Field of Search ..... 225/26, 39, 43, 47, 225/77, 44, 53, 66, 90

[56] References Cited

U.S. PATENT DOCUMENTS

| | | | |
|---|---|---|---|
| 2,924,364 | 2/1960 | Dahlguist | 225/44 X |
| 3,743,151 | 7/1973 | Malcolm | 225/53 X |
| 4,130,229 | 12/1978 | Pagnini | 225/77 X |

FOREIGN PATENT DOCUMENTS

| | | | |
|---|---|---|---|
| 0021377 | 2/1980 | Japan | 225/26 |

*Primary Examiner*—Donald R. Schran
*Assistant Examiner*—Michael D. Folkerts
*Attorney, Agent, or Firm*—McAulay, Fields, Fisher, Goldstein & Nissen

[57] ABSTRACT

A rolled adhesive tape holder having a cutting edge located at a position near to a recess provided so as to allow the tip of the tape which is adhered to the cutting edge to be separated by being pressed with finger.

5 Claims, 2 Drawing Sheets

ROLLED ADHESIVE TAPE HOLDER

BACK GROUND OF THE INVENTION

This invention relates to a holder for holding a type of rolled adhesive tape used to seal envelopes or mend books.

There are two well known types of tape holder, in one of which the core tube of a roll of adhesive tape is engaged with a support tube provided on a primary body member, and in the other of which a primary body member and a support member are formed as separate parts and in which the support member which is in engagement with the core tube of a rolled tape is rotatably mounted on the primary body member. The former is designed to be portable, and the latter as a desk top type.

Although the conventional holder has a cutting edge arranged at a certain distance from the supporting tube for supporting the core tube of the adhesive tape or the supporting member so that the adhesive tape is adhered to the cutting edge with the aid of the adhesive attached to the tape surface and the end of the adhesive tape is thereby prevented from being adhered to main tape body, sometimes the tip of the rolled adhesive tape does not adhere to the cutting edge when the tape is cut, or if adhered it sometimes separates from the cutting edge and adheres to the main body of the roll of adhesive tape. In order to separate the tip of the tape that was adhered to the main tape body, it is necessary to remove the roll from the supporting rod or the supporting member. Separating the tip of the adhesive tape from the main tape body is a troublesome task.

SUMMARY OF THE INVENTION

It is therefore an object of the present invention to provide a rolled adhesive tape holder capable of allowing the tape to be drawn without the tip of the adhesive tape becoming adhered to the main body of the roll of adhesive tape.

BRIEF SUMMARY OF THE DRAWINGS

The accompanying drawings show a rolled tape holder which represents an embodiment of the present invention.

FIG. 3 is a cross-sectional view taken along line I—I'.

DETAILED DESCRIPTION OF THE PREFERRED EMBODIMENT

Figures 1, 2:
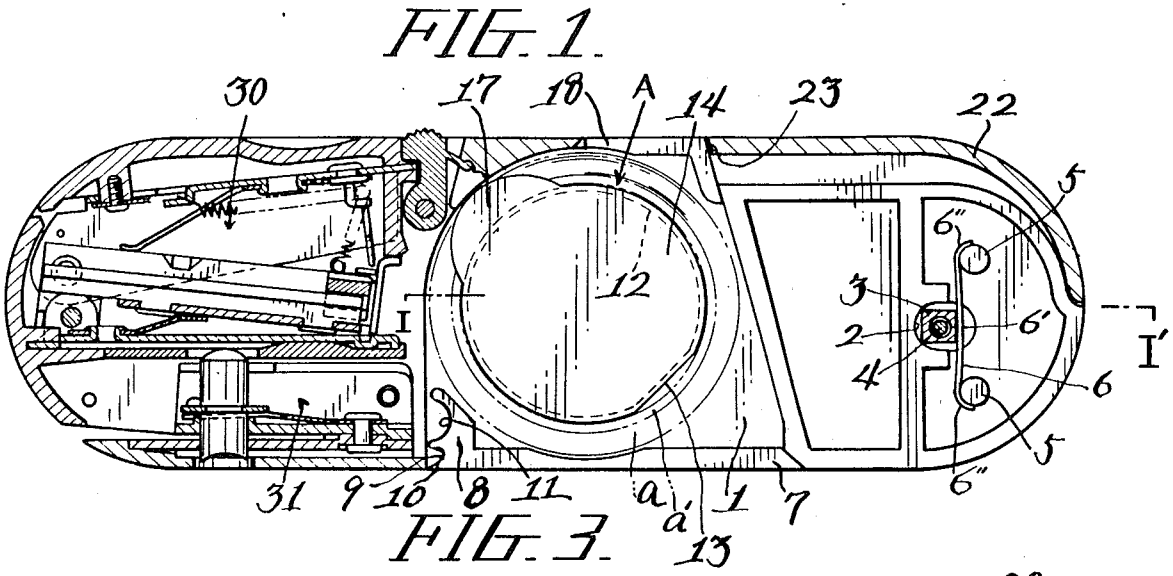
FIG. 1 is a cross-sectional view of the state wherein the holder is retracted in the base.
FIG. 2 is a cross-sectional view of the holder in the projected state.
Figure 2:
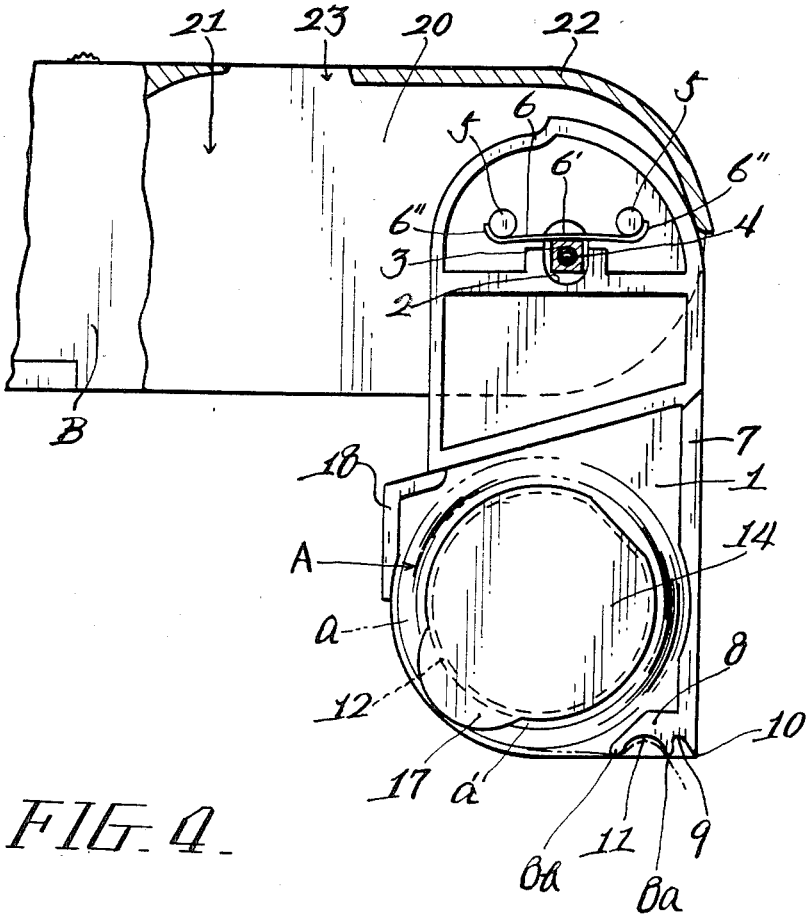
Figure 4:
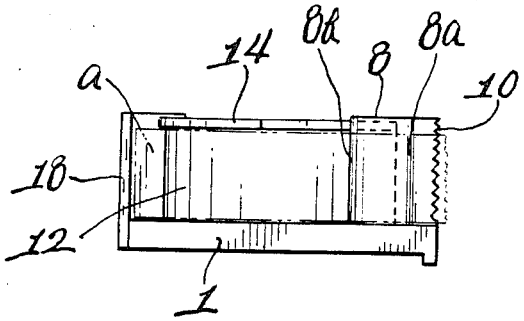
FIG. 4 is a plan view of the relationship between the cutting edge and the recess.

The present invention will be described in detail with reference to the accompanying drawings which show a rolled adhesive tape holder which represents an embodiment of the present invention.

A tape holder A made of synthetic resin has a primary body member 1.

A primary body member 1 has an elongated hole 2 formed in a base portion thereof. A square supporting rod 3 is adapted to pass through this elongated hole 2.

A screw 4 is screwed into the supporting rod 3, thereby attaching the rod to the side plates 20.

Projections 5 are formed on the opposite sides of the elongated hole 2, and the ends 6'' of a spring 6, which is constantly in contact at its intermediate portion 6' with the supporting rod 3, are attached to the projections 5. In this manner, the tape holder A of this embodiment is supported on a base body B such as to be pivotable about the supporting rod 3 and retractable in a gap 21 formed in the base body B.

That is, the holder A is accommodated in the gap 21 formed in the base body B, thereby preventing dust or the like from sticking to a rolled adhesive tape attached to the holder A.

The first member 7 extends from the base portion of the primary body member 1 that projects toward the top of the base body B. The second member 8 is disposed perpendicularly to the first member 7. A groove 9 is provided on the surface of the tip of the second member 8 which is connected to the first member 7. A cutting edge 10 is provided on the groove 9 and a recess 11 is provided adjacent to the cutting edge 10, that is adjacent to the groove 9 and in parallel to the groove 9 and the cutting edge 10. The recess 11 is such a size that a finger tip may fit within it and is located at an intermediate point on the second member 8. The tops of projections **8*a* and 8*b* in which the recess 11 and the groove 9 are provided (higher than the groove 9 and the recess 11) and that of the cutting edge 10 are positioned in one plane. It is preferrable for the recess 11 to be located as near as possible to the cutting edge 10**.

When the tape is cut by the cutting edge 10, the tape tip adheres to the tip of cutting edge 10 and the projection **8*a*, 8*b*. When the tape tip is pressed at the recess 11, tape a adheres to the recess 11 and the tip of the tape separates from the cutting edge so that the tape can be drawn out by fingers. A support tube 12 is formed such as to project in the same direction as that in which the first member 7 projects from the primary body member 1. The outside diameter of the support tube 12 can be engaged with a core tube a' of the rolled adhesive tape a so as to rotatably support the same. A lid 14 is connected through a hinge 13 at a portion of the opening end 12' of the support tube 12, thereby closing the support tube 12 at the opening end 12'. A flange-like projection 15 is formed on the inner surface 14' of the lid 14 which engages with an inner edge of the support tube 12, thereby maintaining the closed state of the support tube 12 at the opening end 12'. An accommodation chamber 16 for accommodating articles (paper clips, staples or the like) is formed inside the support tube 12 by being encircled by the support tube 12 and the lid 14. The lid 14 has a extension 17 formed at an edge portion of the lid 14 in a position opposite to that of the hinge 13 such as to extending outward in the direction perpendicular to the axis of the support tube 12**.

The third member 18 is formed on the primary body member 1 and is engaged with an aperture 23 formed in an intermediate plate 22 which interconnects side plates 20 forming the gap 21 of the base body B. The holder A which is retractable in the gap 21 can be moved from the retracted position in the gap 21 to the projected position by being pressed at the third member 18 from the outside of the base body B.

The base body B also incorporates scissors, a stapler 30, a punching device 31 which are freely drawn out and retracted.

As described above, the tip of the tape is easily separated from the cutting edge by being pressed against the recess and it will be possible to draw the tape by pinching the tape tip with fingers without fear of the tape tip adhering to the main body of the roll of tape.

Additionally it is possible to prevent the tip of the tape from adhering to the surface of the main tape because of the provision of the recess at an intermediate position on the member.

What is claimed is:

1. A rolled adhesive tape holder comprising: a primary body element having a projecting support rod for supporting a roll of adhesive tape thereon; a member extending from said primary body element in the same direction as said support rod and having an end portion thereon; a groove adjacent the end portion of said member extending in the same direction as said member and defined by spaced walls having narrow edges; a cutting edge provided on one of said groove wall edges; and a recess on said member adjacent to said groove and spaced from said cutting edge opposite to the direction of travel of tape from a roll and of sufficient size to accommodate a fingertip therein, the edge of the walls defining said groove and recess being adapted to support the tape in substantially a point contact, whereby depression of the tape into said recess separates the tape end from said cutting edge, and causes the tape end to extend outwardly away from the holding and cutting portion of the member such that it may be grasped by the operator.

2. A rolled adhesive tape holder according to claim 1, in which said support rod comprises at least a wall defining a chamber having an open end, a lid hingedly connected to said wall at one end and adapted to close said open end, and an extension on said lid extending beyond said wall, whereby said extension retains a roll of tape on said support tube and provides a means for opening said chamber.

3. A rolled adhesive tape holder according to claim 1, wherein said cutting edge and the recess are arranged in parrallel.

4. A rolled adhesive tape holder according to claim 1, wherein the tip of said cutting edge and the edge of the walls defining said recess are located in one plane.

5. A rolled adhesive tape holder according to claim 1, wherein said holder is retractably engaged with a base body.

* * * * *